United States Patent [19]

Bloch et al.

[11] 4,452,475

[45] Jun. 5, 1984

[54] DOOR LATCHING DEVICE

[75] Inventors: Einer Bloch, Rungsted Kyst, Denmark; Leif J. E. Strindberg, Täby, Sweden

[73] Assignee: Aktiebolaget Electrolux, Stockholm, Sweden

[21] Appl. No.: 202,011

[22] Filed: Oct. 29, 1980

[30] Foreign Application Priority Data

Nov. 1, 1979 [SE] Sweden ..... 7909047

[51] Int. Cl.[3] ..... E05C 17/56

[52] U.S. Cl. ..... 292/31; 292/251.5

[58] Field of Search ..... 292/DIG. 22, DIG. 71, 292/341.18, 31, 25, 251.5

[56] References Cited

U.S. PATENT DOCUMENTS

| | | | |
|---|---|---|---|
| 916,274 | 3/1909 | Covert | 292/31 |
| 1,557,327 | 10/1925 | Powell | 292/31 |
| 3,599,743 | 8/1971 | Hull | 292/216 |
| 3,626,712 | 12/1971 | Mann et al. | 292/251.5 X |

*Primary Examiner*—Richard E. Moore

*Attorney, Agent, or Firm*—Alfred E. Miller

[57] ABSTRACT

A door with a magnetic sealing strip as a latching means in a refrigerator in a house trailer or the like, may be inadvertently opened when the trailer moves and turns. This is prevented by a movable latching means disposed separately from the latch and arranged under the influence of the force of inertia and against the action of a spring to be brought into a latching position against the door. The force of the spring is selected so as to move the latching means out of engagement with the door when the action of said force of inertia is less than the door latch retaining force.

10 Claims, 6 Drawing Figures

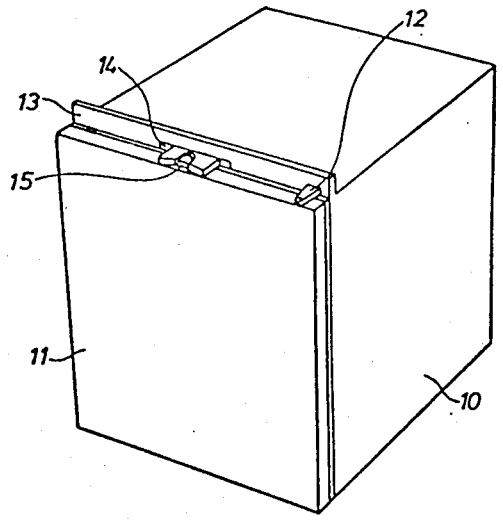
Fig.1
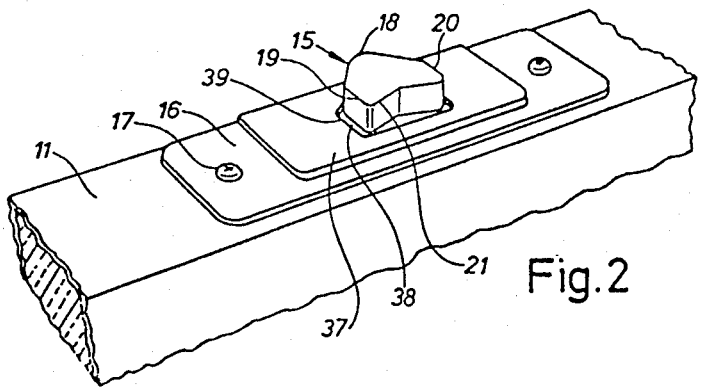
Fig.2
Fig.3
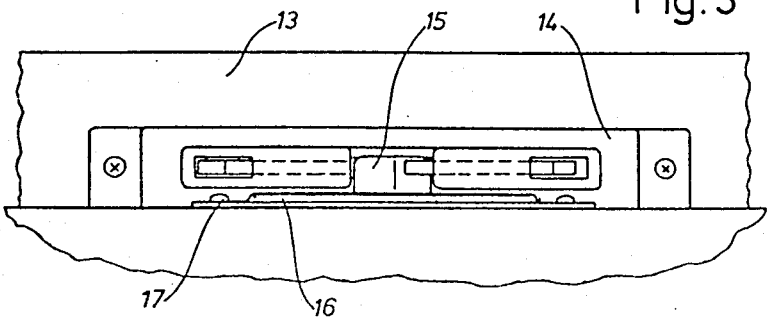

DOOR LATCHING DEVICE

This present invention relates to a latching device for use in a refrigerator of the type used in house trailers and motor homes and which has a lock, for example, a magnetic strip which retains the door in closed position against a door frame with a force that is sufficient when the trailer or the like is parked but is insufficient when the door due to the movement of the trailer when on the road is exposed to a greater force of inertia in the direction outwardly from the door surface.

In trailers and motor homes, a refrigerator with hinged door is used and the door is usually maintained in a closed condition by means of a magnetic sealing strip surrounding the door opening. In a trailer that is stationary the magnetic sealing strip is quite sufficient because it keeps the refrigerator door closed, but permits opening of the same when an adequate pulling force is applied to the door. However, when the trailer or motor home is moving the door is exposed to forces of inertia in the direction away from the refrigerator cabinet, and sometimes these forces exceed the force of the magnetic sealing strip, so that the door may open inadvertently.

An object of this invention is to provide a locking device which does not prevent intentional opening of the door, but which prevents the door from being unintentionally opened under the influence of the force of inertia.

For the above purpose the invention is generally characterized by a movable latching means disposed separately from the door latch and arranged under the influence of the force of inertia and against the action of a spring to be brought into latching position against the door, the spring force being selected so as to move the latching means out of engagement with the door when the action of the said force of inertia is less than the door latching retaining force.

In order that the invention will be more clearly understood, it will now be disclosed in greater detail with reference to the accompanying drawing, in which:

FIG. 1 is a perspective view of a refrigerator embodying our invention.

FIG. 2 is a perspective view on an enlarged scale of a section of the upper edge of the refrigerator door with the latching stub.

FIG. 3 is a front view of the latching device.

Figure 4:
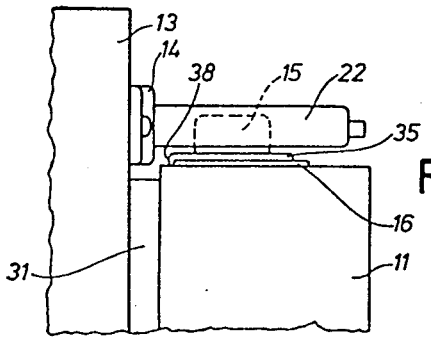
FIG. 4 is a side elevational view thereof.

The refrigerator 10, as shown in FIG. 1, has a door 11 supported on hinges 12 at its right-hand edge. At its upper front part the refrigerator has a border 13 with a fitting 14. At the upper edge of the door 11 is a latching stub 15, which is shown on a larger scale in FIG. 2. The latching stub is associated with a metal plate 16, fastened to the upper edge of the door 11 by means of screws 17. The shape of the latching stub, as seen from above, can generally be described as triangular, with its apex 18 directed towards the refrigerator, two parallel sides 19 and 20, and having an obtuse angle or curvature 21 at the side facing away from the refrigerator.

The latching stub 15 is disposed in the middle of the upper edge of the door, and the fitting 14 is correspondingly located at the front of the refrigerator. Thus, the latching device can be used in a door hinged to the right as well as in a door hinged to the left, and also in doors in which it is possible to move the hinges from one side to the other, if desired.

Figure 5:
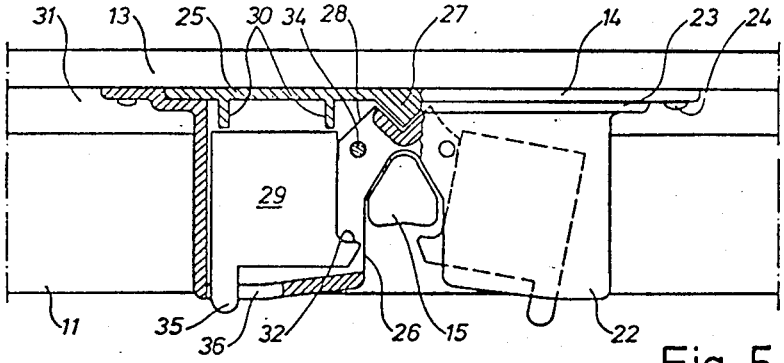
FIGS. 5 and 6 show the latching device, with some parts broken away for reasons of clarity, in a top plan view illustrating the inactive and active position, respectively.
Figure 6:
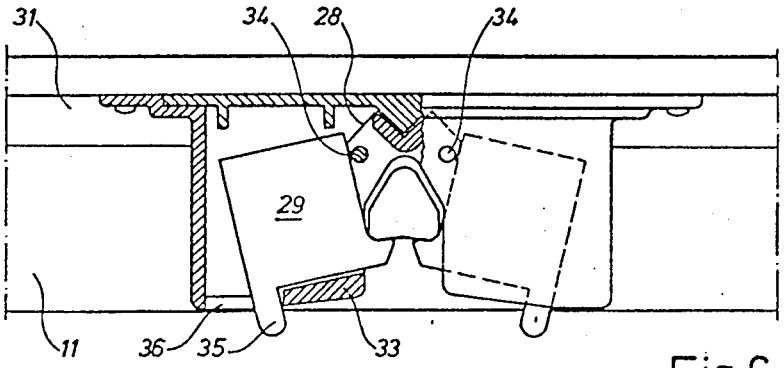

The location of the fitting 14 on the cabinet front 13 and the position of the latching stub 15 on the door 11 appear in FIGS. 3 and 4, whereas the parts and the function of the latching device are best seen in FIGS. 5 and 6.

The fitting 14 is in the form of a flat box 22 with openings and a flange 23, which by means of screws 24 is attached to the front border 13. The flange 23 supports a plate 25 against the cabinet front. In its central part the box 22 has a cut-out portion 26 into which the latching stub 15 fits when the door is closed. Directly opposite the latching stub 15 and the cut-out portion 26, the plate 25 has a holder 27 for a leaf spring 28 as seen in the left-hand side of FIGS. 5 and 6. This spring is directed obliquely outward and is attached to a plate 29 which, when the latching device is inactive, by the action of the spring 28, rests on two shoulders 30 of the plate 25.

When the refrigerator cabinet is exposed to a force of inertia in a direction to move the door out from engagement with the cabinet, this movement is at first counteracted by a magnetic sealing strip 31 between the door 11 and the cabinet 10. If the force is too great for the attraction power of the magnetic strip, the latter cannot retain the door, which tends to move outwardly to an open position. Meanwhile, however, the plate 29 also has been exposed to the same inertia force, and consequently swivels about the holder 27 so that a hook 32 on the plate comes into a position in front of the latching stub 15 so as to rest against a wall part 33 of the box 22. The hook extends in the direction of movement of the plate. Thus, the movement of the door to an open position is interrupted.

The turning forces acting on the plate 29 cannot be avoided. Since the spring might be damaged if loaded by these forces, the plate is arranged to rest in its latching position on the support pins 34 provided in the box 22.

The plate 29 has an outwardly directed pin 35 projecting through a slot 36 in the box 22. If for some reason the parts of the locking device after the door has been latched should not move back into the inactive position, it is thus possible to move the pin 35 with a finger from the position shown in FIG. 6 to the left into the inactive position shown in FIG. 5.

As appears from FIGS. 5 and 6, the latching device has two latching mechanisms of the type described above. The left-hand mechanism, which can be seen in detail, has been described above and the right-hand one is the mirror image of the other one, and acts in the same manner. Forces of inertia in different directions may appear but still have a sufficiently great component in the direction causing the door to open. Such a force of inertia in the direction of the spring 28 acts with its entire force on the other spring and the plate. Then the movement of the stub 15 is interrupted by the right-hand plate or the latch plate. Correspondingly, a force in the direction of the right-hand spring causes full action on the left-hand plate 29.

As appears from FIGS. 2 and 4, the metal plate 16, to which the latching stub 15 is secured, is not quite level. It has an elevated central portion 37. The latching stub 15 is fixedly connected to a metal plate 38 (FIG. 2) situated under the central portion 37. The latching stub 15 projects through a hole 39 in the central portion which has a downwardly bent edge 40 at the rear side of the door. The extension of the plate 38 in the direction of the edge of the door is less than that of the central portion 37, and hence the latching stub 15 is to some extent movable laterally. Thus, it is not necessary to observe accurate tolerances when mounting the locking device. Due to the wedge shape of the latching stub 15, on closing of the door it will always be moved into the correct position between the lateral planes of the cut-out portion 26 of the box 22 attached to the cabinet front.

What is claimed is:

1. A latching device for use in a refrigerator in a house trailer or the like comprising: a magnetic strip that retains the refrigerator door in a closed position against a door frame of the refrigerator cabinet with a force which is sufficient when the trailer is parked, but insufficient when the door upon movement of the trailer is exposed to a greater force of inertia in the direction outwardly from the door surface, a catch on said refrigerator door, a movable latching means mounted on the door frame of said refrigerator cabinet, a spring, said latching means being disposed separately from the magnetic strip and arranged under the influence of the force of inertia in a direction to move said door out of engagement with the cabinet, and against the action of said spring to be brought into a latching position against said refrigerator catch, the force of the spring being selected so as to move said latching means out of engagement with said catch when the action of the said force of inertia is less than the door latch retaining force.

2. A latching device for use in a refrigerator in a house trailer or the like comprising: a primary latching arrangement that retains a refrigerator door in a closed position against the door frame of the refrigerator cabinet with a force that is sufficient when the trailer is parked, but insufficient when the door upon movement of the trailer is exposed to a greater force of inertia in a direction outwardly from the door surface a secondary movable latching means and a catch mounted on the door frame of said refrigerator cabinet, a spring, said secondary latching means being disposed separately from said primary latching means, and arranged under the influence of the force of inertia in a direction to move said door out of engagement with the cabinet, and against the action of said spring to be brought into a latching position into engagement with said catch, the force of the spring being selected so as to move said secondary latching means out of engagement with said catch when the action of said force of inertia is less than the door latch retaining force of said primary latching arrangement.

3. A latching device according to claim 2 wherein said secondary latching means is at least one movable latching plate active between the door frame and door, and a fixed stub mounted substantially in the middle of the upper edge of the door, the movable latching plate being arranged to be moved into latching position by the force of inertia and against the action of said spring whose force is so directed that the latching plate is moved out of engagement with said stub when the said force of inertia is small or inactive.

4. A latching device according to claim 3 wherein said stub is mounted on said door and said latching plate on said door frame.

5. A latching device according to claim 4 wherein said stub is adjustable horizontally.

6. A latching device according to claim 4 wherein said latching plate is movable in a horizontal plane and is provided with a hook extending out from the front plane of said cabinet and in the direction of movement of the plate.

7. A latching device according to claim 6 wherein said latching plate is attached to the frame by said spring.

8. A latching device according to claim 7 wherein said latching plate is attached to the frame by said spring which may be bent in a horizontal plane.

9. A latching device as claimed in claim 8 further comprising means for supporting said latching plate in its latched position in order to absorb forces acting on said door.

10. A latching device as claimed in claim 2 further having a projecting pin to manually rest the latching plate into its inactive position.

* * * * *